US008894180B2

(12) United States Patent
O'Hara et al.

(10) Patent No.: US 8,894,180 B2
(45) Date of Patent: Nov. 25, 2014

(54) GUIDE FOR A WIPING ASSEMBLY

(71) Applicant: Hewlett-Packard Development Company, L.P., Houston, TX (US)

(72) Inventors: Steve A. O'Hara, Vancouver, WA (US); Steven P. Downing, Vancouver, WA (US); Teressa L. Roth, Vancouver, WA (US); Sierra Lynn Triebe, Vancouver, WA (US); Brian Mar, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 84 days.

(21) Appl. No.: 13/743,521

(22) Filed: Jan. 17, 2013

(65) Prior Publication Data

US 2014/0198155 A1 Jul. 17, 2014

(51) Int. Cl.
*B41J 2/165* (2006.01)

(52) U.S. Cl.
CPC ..... *B41J 2/16535* (2013.01); *B41J 2/16547* (2013.01); *B41J 2/16538* (2013.01); *B41J 2/16517* (2013.01); *B41J 2/16544* (2013.01); *B41J 2/16585* (2013.01)
USPC ..... 347/33; 347/32; 347/22

(58) Field of Classification Search
CPC ..... B41J 2/16535; B41J 2/16544; B41J 2/16538; B41J 2/16547; B41J 2/16517
USPC ..... 347/33, 32, 22
See application file for complete search history.

(56) References Cited

U.S. PATENT DOCUMENTS

| | | | | |
|---|---|---|---|---|
| 6,595,619 | B2 | 7/2003 | Barinaga et al. | |
| 6,637,856 | B2 | 10/2003 | Nishi et al. | |
| 6,679,601 | B1 * | 1/2004 | Pham et al. | 347/104 |
| 7,344,222 | B2 * | 3/2008 | Nakamura | 347/33 |
| 8,342,639 | B2 * | 1/2013 | Inoue | 347/33 |
| 8,752,934 | B2 * | 6/2014 | Bernard | 347/33 |
| 2004/0070659 | A1 | 4/2004 | Lee | |
| 2009/0289993 | A1 * | 11/2009 | Yamaguchi | 347/33 |
| 2010/0315463 | A1 | 12/2010 | Escude et al. | |
| 2011/0279532 | A1 | 11/2011 | Love et al. | |

* cited by examiner

*Primary Examiner* — Henok Legesse

(57) ABSTRACT

A wiping assembly includes a pair of guide elements located at opposite ends of a headland region of a fluid ejection assembly to extend in a second orientation generally perpendicular to a first orientation through which the opposite ends extend. Each guide element includes at least one first portion and a second portion. The at least one first portion selectively receives biased releasable engagement from a non-wiping portion of a wiping element extending along the first orientation to cause a wiping portion of the wiping element to be in generally parallel relation to, and spaced apart from, the headland region. The second portion causes the non-wiping portion to no longer be in biased releasable engagement against the guide element and causes the wiping portion to be biased in wiping relation against the headland region.

20 Claims, 8 Drawing Sheets

GUIDE FOR A WIPING ASSEMBLY

BACKGROUND

Printing systems typically perform routine maintenance to achieve optimal printing performance. For some types of printers that include fluid ejection devices, such maintenance frequently includes spitting and wiping along with other types of maintenance.

DETAILED DESCRIPTION

Figure 1:
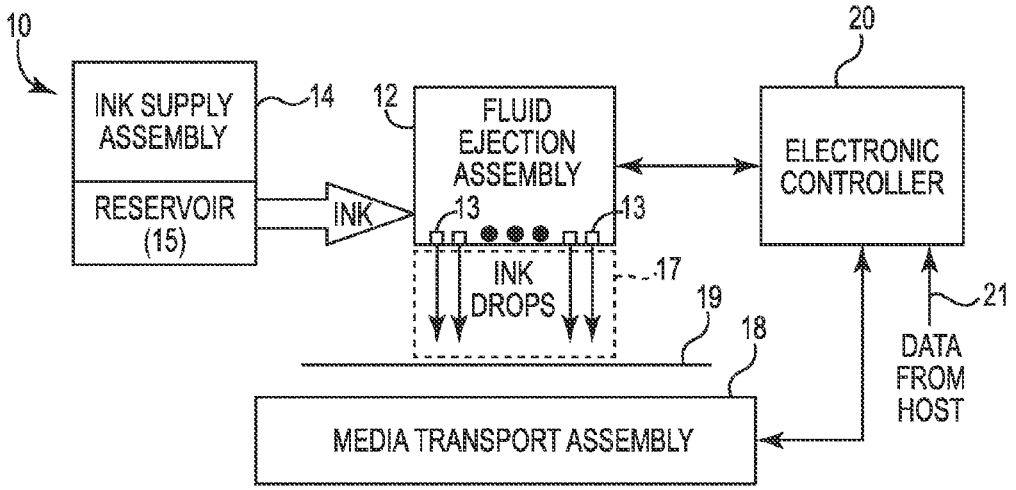
FIG. 1 is a block diagram schematically illustrating a printing system, according to one example of the present disclosure.

In the following detailed description, reference is made to the accompanying drawings which form a part hereof, and in which is shown by way of illustration specific examples which may be practiced. In this regard, directional terminology, such as "top," "bottom," "front," "back," "leading," "trailing," etc., is used with reference to the orientation of the Figure(s) being described. Because components in these examples can be positioned in a number of different orientations, the directional terminology is used for purposes of illustration and is in no way limiting. It is to be understood that other examples may be utilized and structural or logical changes may be made without departing from the scope of the present disclosure. The following detailed description, therefore, is not to be taken in a limiting sense.

At least some examples of the present disclosure are directed to a guide system to guide a wiping portion of a wiping assembly and a headland region of a fluid ejection assembly into a generally parallel wiping relation to each other.

In some examples, a wiping assembly includes a pair of guide elements located at opposite ends of a headland region of a fluid ejection assembly to extend in a second orientation generally perpendicular to a first orientation through which the opposite ends extend. Each guide element includes at least one first portion and a second portion. The at least one first portion selectively receives biased releasable engagement relative to a non-wiping portion of a wiping element to cause a wiping portion of the wiping element (which extends along the first orientation) to be in generally parallel relation to, and spaced apart from, the headland region. The second portion causes the non-wiping portion to no longer be in biased releasable engagement against the guide element and causes the wiping portion to be in biased wiping relation against the headland region.

In some examples, the biased releasable engagement comprises biased sliding contact. In some examples, the biased releasable engagement comprises biased rolling contact.

In some examples, the headland region includes an array of fluid ejection devices, including but not limited to, inkjet printheads or other types of printheads. In some examples, the headland region includes a face portion at least partially surrounding and supporting the fluid ejection devices.

In some examples, prior to wiping nozzles of fluid ejection devices with the wiping portion of the wiping element, the guide elements and the non-wiping portion of the wiping element interact together to ensure proper registration of the wiping element relative to the headland region of the fluid ejection assembly. In particular, via a positioner, the guide elements located at the headland region come into biased releasable engagement relative to the non-wiping portion of the wiping element to cause a wiping portion of wiping element to become aligned or registered in a generally parallel position relative to the face portion of the headland region at which nozzles of the printheads are located. Such registration ensures consistent, effective wiping of the nozzles and of the at least partially surrounding face portion of the headland region of the fluid ejection assembly.

In one aspect, the registration mechanism provided via examples of the present disclosure avoids the complexity in traditional or existing systems that attempt to achieve a desired wiping relation via each separate assembly (a wiper assembly and a fluid ejection assembly) having its own steering or alignment elements that operate completely independently from each other while still aiming to achieve a desired alignment of those system with each other. Among other deficiencies, in one aspect, at least some of these traditional systems do not establish any contact with each other prior to the actual wiping contact between the wiper assembly and the fluid ejection assembly, and therefore proper alignment is difficult to achieve.

In sharp contrast, in one aspect, at least some examples of the present disclosure operate like a docking arrangement in which one system (e.g. a wiping assembly) and another system (e.g. a fluid ejection assembly) each include a non-wiping component that makes contact with each other to establish proper alignment of the wiping assembly and the fluid ejection assembly in a generally parallel relation in order to later enable a generally parallel wiping relation. By doing so, a much closer tolerance loop is achieved to ensure precise and accurate alignment of the wiping assembly relative to target surface of the fluid ejection assembly. As noted above, in some examples, such docking arrangements are provided via the guide elements associated with a fluid ejection assembly and a non-wiping component associated with a wiping assembly.

These example printing systems, and other example printing systems, are described and illustrated in association with FIGS. 1-15.

FIG. 1 is a block diagram schematically illustrating a printing system 10, according to one example of the present disclosure. As shown in FIG. 1, printing system 10 includes a fluid ejection assembly 12, an ink supply assembly 14, a media transport assembly 18, and an electronic controller 20. In one example, the fluid ejection assembly 12 includes at least one fluid ejection device which ejects drops of ink through orifices or nozzles 13 and toward a print media 19 so as to print onto print media 19. In one example, the at least one fluid ejection device comprises an inkjet printhead. In some examples, the at least one fluid ejection device comprises other types of printheads. Print media 19 is any type of suitable sheet material, such as paper, card stock, envelopes, labels, transparencies, and the like. Typically, nozzles 13 are arranged in at least one column or at least one array such that properly sequenced ejection of ink from nozzles 13 causes characters, symbols, and/or other graphics or images to be printed upon print media 19 as relative movement occurs between fluid ejection assembly 12 and print media 19.

In one aspect, ink supply assembly 14 supplies ink to fluid ejection assembly 12 and includes a reservoir 15 for storing ink. As such, ink flows from reservoir 15 to fluid ejection assembly 12, such as an inkjet printhead assembly. In one example, fluid ejection assembly 12 and ink supply assembly 14 are housed together in a single housing. In some examples, ink supply assembly 14 is separate from fluid ejection assembly 12 but still directly communicates ink to the fluid ejection assembly 12 via a releasable connection with the ink supply assembly 14 being mounted directly above and at least partially supported by the printhead assembly 12. This example is sometimes referred to as an on-axis configuration of the ink supply assembly 14.

In some examples, the ink supply assembly 14 is positioned remotely from the fluid ejection assembly 12, with the ink supply assembly 14 communicating ink to the fluid ejection assembly 12 via an array of supply tubes. This example is sometimes referred to as an off-axis configuration of the ink supply assembly 14.

Media transport assembly 18 positions print media 19 relative to fluid ejection assembly 12. Thus, a print zone 17 is defined adjacent to nozzles 13 in an area between fluid ejection assembly 12 and print media 19. In one example, fluid ejection assembly 12 is a non-scanning-type fluid ejection assembly, such as a page wide array of fluid ejection devices. In one aspect, the non-scanning-type fluid ejection assembly does not move laterally across a page during printing. Rather, media transport assembly 18 advances or positions print media 19 relative to the fluid ejection assembly 12 that is stationary at least during printing.

In one example, electronic controller 20 communicates with at least fluid ejection assembly 12 and media transport assembly 18. In some examples, electronic controller 20 receives data 21 from a host system, such as a computer, and includes memory for temporarily storing data 21. Typically, data 21 is sent to printing system 10 along an electronic, infrared, optical or other information transfer path. Data 21 represents, for example, an image, a document, and/or file to be printed. As such, data 21 forms a print job for printing system 10 and includes print job commands and/or command parameters.

In one example, electronic controller 20 provides control of fluid ejection assembly 12 including timing control for ejection of ink drops from nozzles 13. As such, electronic controller 20 operates on data 21 to define a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on fluid ejection assembly 12. In another embodiment, at least some of the logic and drive circuitry is located remotely from fluid ejection assembly 12.

Figure 2:
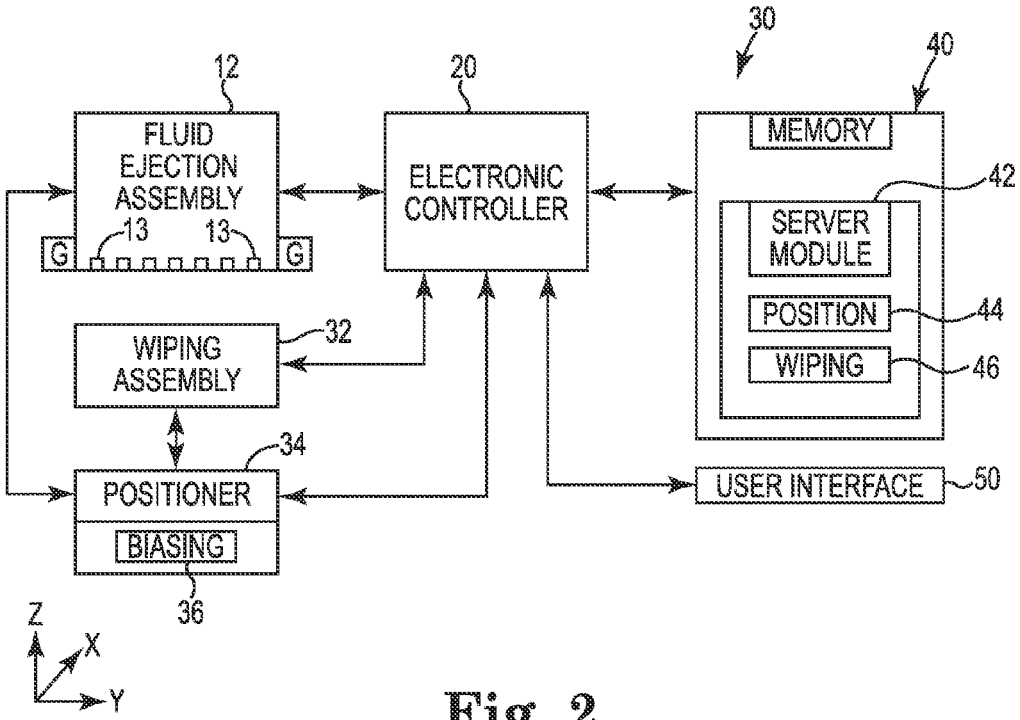
FIG. 2 is a block diagram schematically illustrating a printing system, according to one example of the present disclosure.

FIG. 2 is a block diagram schematically illustrating a printing system 30, according to one example of the present disclosure. In one example, the printing system 30 includes at least substantially the same features and attributes as printing system 10 as previously described in association with FIG. 1, with like components identified via like reference numerals.

In one example, printing system 30 includes fluid ejection assembly 12, electronic controller 20, wiping assembly 32, positioner 34, and memory 40. In general terms, wiping assembly 32 is provided for performing periodic maintenance operations on fluid ejection assembly 12, such as inkjet printheads.

In one example, wiping assembly 32 is stationary (or becomes stationary at least during a portion of the maintenance operations) and the fluid ejection assembly 12 is moved (via positioner 34 in FIG. 2) to position at least the fluid ejection assembly 12, and in particular at least nozzles 13, into wiping relation to the wiping assembly 32. In this example, positioner 34 comprises a carriage assembly for moving fluid ejection assembly 12 into a servicing position, among other possible locations.

In some examples, fluid ejection assembly 12 is stationary (or become stationary at least during a portion of such maintenance operations) and wiping assembly 32 is moved into wiping relation to at least the nozzles of the fluid ejection assembly 12.

In some examples, both the fluid ejection assembly 12 and the wiping assembly 32 are movable with respect to each other.

In some examples, whether wiping assembly 32 is stationary, the fluid ejection assembly 12 is stationary, or both wiping assembly 32 and the fluid ejection assembly 12 are both movable relative to each other, the positioner 34 selectively urges at least a portion of wiping assembly 32 and at least the nozzles 13 of the fluid ejection assembly 12 into biased releasable contact against each other during a wiping action relative to nozzles 13. In some of these examples, positioner 34 comprises a sled or tray for moving at least one of the wiping assembly 32 and the fluid ejection assembly 12 into a servicing relation to each other. In one aspect, positioner 34 supports wiping assembly 32 and is movable relative to the fluid ejection assembly 12. In some examples, positioner 34 includes a biasing function 36 to urge at least a portion of wiping assembly 32 and at least the nozzles of the fluid ejection assembly 12 into biased releasable contact to each other during a wiping action relative to nozzles 13. In one example, the biasing function 36 is provided via at least one spring such that contact of portion of wiping assembly 32 relative to fluid ejection assembly 12 results in the spring urging the wiping assembly 32 and the fluid ejection assembly 12 toward and against each other.

In one example, as further shown in FIG. 2, printing system 30 includes guide portions (G) associated with fluid ejection assembly 12 and which form a portion of a guide system for wiping assembly 32. In some examples, the guide portions (G) are removably attachable to a portion of fluid ejection assembly 12 while in some examples, guide portions (G) are formed integrally as part of a housing of fluid ejection assembly 12. In either case, guide portions (G) enable registration or alignment of portions of wiping assembly 32 relative to at least a nozzle portion (e.g. nozzles 13) of fluid ejection assembly 12 to establish a wiping relation therebetween.

In another aspect, prior to wiping nozzles 13, the guide portions (G) engage a non-wiping guide component of wiping assembly 32 to ensure proper registration of the wiping assembly 32 relative to a headland region or face portion of fluid ejection assembly 12. In particular, guide portions (G) engage the non-wiping guide component associated with wiping assembly 32 to cause a wiping portion of wiping assembly 32 to become aligned or registered in a generally parallel position relative to at least a surface portion of fluid ejection assembly 12 at which nozzles 13 are located. Such registration ensures consistent, effective wiping of nozzles 13 and the surrounding face portions of headland region of fluid ejection assembly 12.

In one aspect, the registration mechanism provided via examples of the present disclosure avoids the complexity in traditional or existing systems that attempt to achieve a desired wiping relation via each separate assembly (a wiper assembly and a fluid ejection assembly) having its own steering or alignment elements that operate completely independently from each other while still aiming to achieve a desired alignment of those system with each other. Among other deficiencies, at least some of these traditional systems do not establish any contact with each other prior to the actual wiping contact between the wiper assembly and the fluid ejection assembly.

In sharp contrast, in one aspect, at least some examples of the present disclosure operate like a docking arrangement in which one system (e.g. a wiping assembly) and another system (e.g. a fluid ejection assembly) each include a non-wiping component that makes releasable contact with each other to establish proper alignment of the wiping assembly and the fluid ejection assembly in a generally parallel relation in order to later enable a generally parallel wiping relation. By doing so, a much closer tolerance loop is achieved to ensure precise and accurate alignment of the wiping assembly relative to target surface of the fluid ejection assembly. As noted above, in some examples, one such docking arrangement is provided via the guide portions (G) of fluid ejection assembly 12 and a non-wiping component of wiping assembly 32.

More specific aspects regarding the features of guide portions (G) associated with fluid ejection assembly 12 and the non-wiping guide components associated with wiping assembly 32 will be later described in further detail in association with at least FIGS. 3-12.

With further reference to FIG. 2, in some examples, printing system 30 includes the previously mentioned controller 20 and memory 30.

In one example, controller 20 comprises at least one processor and associated memories to generate control signals directing operation of at least some components of printing system 30 of FIG. 2 and/or printing system 10 of FIG. 1. In particular, in response to or based upon commands from a user interface 50 and/or machine readable instructions (including software) contained in the memory 40 associated with controller 20, controller 20 generates control signals directing operation of printing systems 10, 30 shown in FIGS. 1 and 2, respectively. In one example, controller 20 is embodied in a general purpose computer.

For purposes of this application, in reference to the controller 20, the term "processor" shall mean a presently developed or future developed processor (or processing resources) that executes sequences of machine readable instructions (such as but not limited to software) contained in a memory. Execution of the sequences of machine readable instructions causes the processor to perform actions, such as operating printing system 30 to cause wiping assembly 32 be properly aligned relative to fluid ejection assembly 12 and then to wipe a portion of fluid ejection assembly 12, in the manner described in at least some examples of the present disclosure. The machine readable instructions may be loaded in a random access memory (RAM) for execution by the processor from their stored location in a read only memory (ROM), a mass storage device, or some other persistent storage or non-volatile form of memory, as represented by memory 40. In one example, memory 40 comprises a computer readable medium providing non-volatile storage of the machine readable instructions executable by a process of controller 20. In other examples, hard wired circuitry may be used in place of or in combination with machine readable instructions (including software) to implement the functions described. For example, controller 20 may be embodied as part of at least one application-specific integrated circuit (ASIC). In at least some examples, the controller 20 is not limited to any specific combination of hardware circuitry and machine readable instructions (including software), nor limited to any particular source for the machine readable instructions executed by the controller 20.

In one example, memory 40 stores a service module 42 including machine readable instructions for directing components of printing system 30 to service fluid ejection assembly 12. In some examples, service module 42 includes a position function 44 and a wiping function 46. In some examples, the position function 44 controls operation of positioner 34 to maneuver wiping assembly 32 into wiping relation relative to an at least temporarily stationary fluid ejection assembly 12 or to maneuver fluid ejection assembly 12 into wiping relation relative to an at least temporarily stationary wiping assembly 32, in some examples. In one aspect, this maneuvering includes directing engagement of a guide component associated with wiping assembly 32 relative to guide portions (G) associated with fluid ejection assembly 12 to ensure generally parallel registration of portions of wiping assembly 32 relative to target portions of fluid ejection assembly 12. Thereafter, wiping function 46 directs operation of wiping of fluid ejection assembly 12 via wiping components of wiping assembly 32.

In one example, in cooperation with controller 20 and memory 40, user interface 50 comprises a graphical user interface or other display that provides for the simultaneous display, activation, and/or operation of various components, functions, features, and modules of printing system 10 or printing system 30, described in association with at least FIGS. 1-2.

Figure 3:
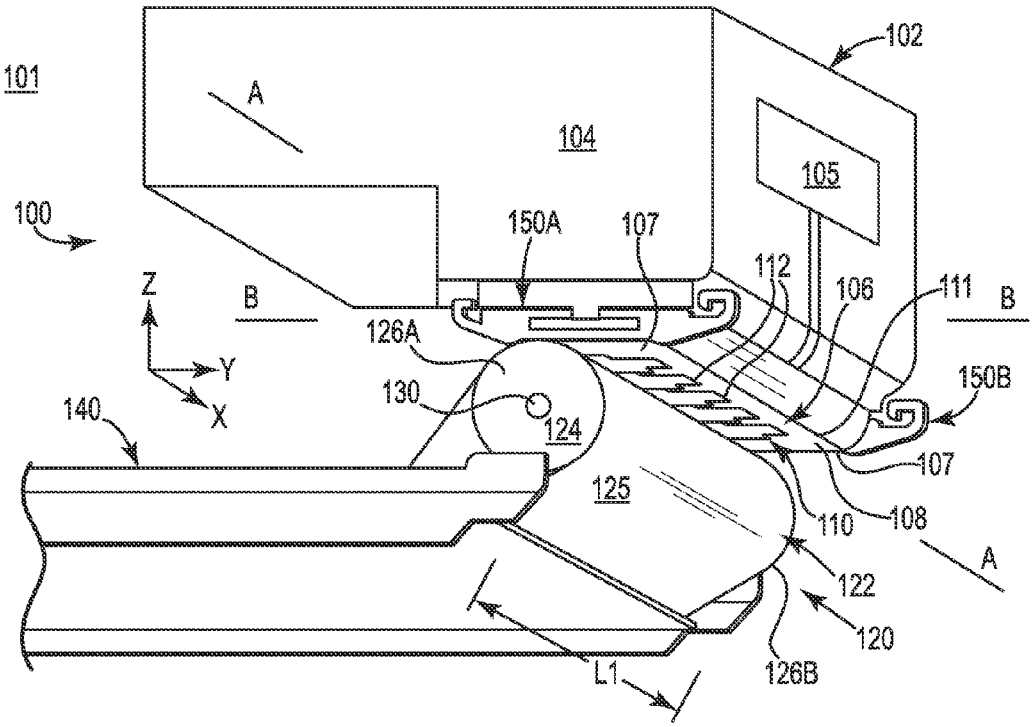
FIG. 3 is a diagram including a perspective view schematically illustrating a printing system, according to one example of the present disclosure.

FIG. 3 is a diagram 101 including a perspective view schematically illustrating a printing system 100, according to one example of the present disclosure. In one example, printing system 100 comprises at least some of substantially the same features and attributes as printing systems 10, 30 as previously described in association with FIGS. 1-2.

As shown in FIG. 3, printing system 100 includes a fluid ejection assembly 102 including a housing 104, a headland region 106, and circuitry 105 in communication with operative components of headland region 106. In one example, the headland region 106 includes an array 110 of printheads 112 which are supported by and at least partially surrounded by a face portion 108. In some instances, the headland region 106 can be referred to as a printhead region which includes the printheads 112 and the face portion 108. In one aspect, the headland region 106 includes opposite end portions 107 and opposite side edges 111, just one of which is shown in FIG. 3. In another aspect, because at least some portions of the face portion 108 generally surround the printheads 112, the opposite side edges 111 of the headland region 106 generally coincide with opposite side edges of the face portion 108 and then opposite end portions 107 of the headland region 106 generally coincide with opposite end portions of the face portion 108.

In some examples, the array 110 comprises a page wide array of printheads 112 with array 110 sized to extend across a width of a page or sheet of media to be printed on such that fluid ejection assembly 102 remains stationary during printing. In other words, fluid ejection assembly 102 does not scan back-and-forth across the width of the page or sheet of media during printing. In one example, a media has a width of about 8½ inches, while in some examples, the width of media is less than 8½ inches and in some examples, the width of media is greater than 8½ inches.

As further shown in FIG. 3, printing system 100 further comprises a wiping assembly 120 that includes a wiping element 122 for wiping headland region 106 of fluid ejection assembly 102. In one example, as shown in FIG. 2, wiping element 122 includes an elongate, generally cylindrically shaped roller 124 supporting a belt 125 of wiping material. In some examples, the belt 125 is made of a web-like material that includes an at least partially absorbent component. In one example, the belt 125 has a length (L1) extending along the X orientation that is generally the same length or is slightly longer than a length of at least the array 110 of printheads 112 of the headland region 106 of fluid ejection assembly 102, which generally extends in the X orientation. In one example, the belt has a length (L1) of about 10 inches when the headland region 106 is sized to print on media having a width of about 8½ inches.

In one aspect, the roller 124 is rotationally supported via an axle 130 at one end of a sled or tray 140. In some examples, the sled 140 comprises a portion of a positioner, such as the previously described positioner 34 (FIG. 2).

In general terms, sled 140 is arranged and roller 124 is supported so that roller 124 and a width (W1) of belt 125 extends generally parallel to a length or longitudinal axis (A) of array 110 of printheads 112 across headland region 106, as shown in FIG. 3.

As further shown in FIG. 3, a pair of elongate guides 150A, 150B are located at opposite ends 107 of printhead region 106 and act to guide wiping element 122 into generally parallel wiping relation to printhead region 106. In one aspect, a longitudinal axis (B) of each guide element 150A, 150B extends generally parallel to an Y orientation along which a media moves (i.e. media movement direction) and along which wiping element 122 moves relative to headland region 106 (or vice versa). Being located at opposite ends 107 of printhead region 106, the guide elements 150A, 150B are spaced apart from each other in X orientation. In some examples, the guide elements 150A, 150B are removably attachable relative to the opposite end portions 107 of the headland region 106. Accordingly, in some instances, the guide elements 150A, 150B can be retrofitted to an existing fluid ejection assembly previously lacking such guiding structures.

In some examples, the guide elements 150A, 150B are integrally molded as part of the structure of the fluid ejection assembly 102 to be permanently located at the opposite end portions 107 of the headland region 106, and therefore the guide elements 150A, 150B are not removably attachable components.

More specific aspects of guide elements 150A, 150B, and their relation to wiping element 122, are further described in association with at least FIGS. 4-12

Figure 4:
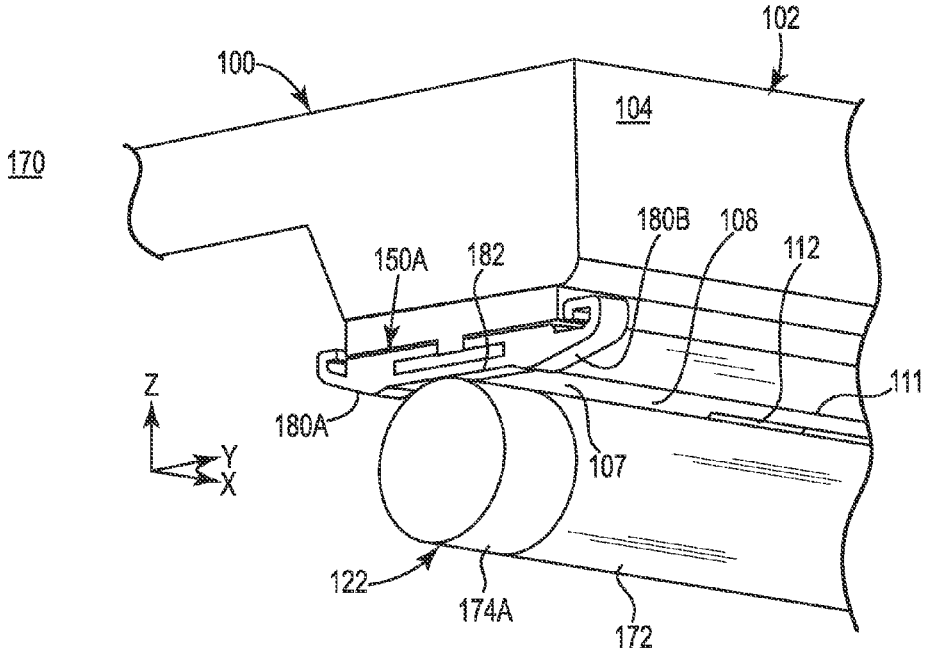
FIG. 4 is a diagram including a perspective view schematically a printing system, according to one example of the present disclosure.

FIG. 4 is a diagram 170 including a perspective view schematically illustrating a printing system 170, according to one example of the present disclosure. In one example, printing system 170 comprises at least some of substantially the same features and attributes as printing systems 10, 30, 100, as previously described in association with FIGS. 1-3, respectively.

As shown in FIG. 4, in some examples, a pair of guide elements 150A, 150B each includes receiving portions 180A, 180B at opposite ends of a central recessed portion 182. Meanwhile, in some examples, wiping element 122 includes a compressible sleeve 172 mounted on roller 124 (hidden behind sleeve 172 in FIG. 4) and a guide component 174A mounted on and extending laterally of end 126A roller 124. In some examples, this guide component 174A includes a generally disc shaped member attachable to the end 126A of roller 124. In some examples, the guide component 174A provides an at least partially generally arcuate shape (e.g. ellipse, circular, undulating) for engaging guide element 150A, but does not form a disc shape. In some examples, the guide component 174A comprises other shapes as further described later in association with FIG. 14. Accordingly, the guide component 174A can take a variety of forms and shapes suitable to slidably engage guide element 150A.

Further, it will be understood that guide element 150A and guide component 174A at end 126A of roller 124 is representative of another guide element 150B and guide component 174B that are operatively deployed at the opposite end 126B of roller 125, although not visible in FIG. 4. In one aspect, the disc-shaped guide components 174A, 174B are associated with wiping assembly 32. However, in another aspect, guide components 174A, 174B define part of a guide system that also includes guide elements 150A, 150B associated with fluid ejection assembly 102.

It will be understood that in FIG. 4, the belt 125 is omitted for illustrative purposes to highlight the relative position of the compressible sleeve 172, disc 174, headland region 106 and guide element 150A.

As further shown in FIG. 4, each receiving portion 180A, 180B is disposed adjacent opposite side edges 111 of the headland region 106 of the fluid ejection assembly 102 with each side edge 111 of the headland region 106 extending generally parallel to the X orientation. While just one side edge 111 is visible in FIG. 4, both side edges 111 of headland region 106 are shown later in at least FIGS. 6-8.

With further reference to FIG. 4, in some examples, the generally central recessed portion 182 of both guide elements 150A, 150B extend in substantially the same plane, the receiving portions 180A of guide elements 150A, 150B extend in substantially the same plane as each other, and the receiving portions 180B of guide elements 150A, 150B extend in substantially the same plane as each other. With this arrangement, the guide elements 150A, 150B are configured to cause the wiping element to have an orientation that is generally parallel relative to the headland region.

As shown in FIG. 4, guide component 174A associated with wiping element 122 and guide element 150A associated with fluid ejection assembly 102 have been positioned in operative releasable engagement relative to each other. As further described later in association with at least FIGS. 5-12, this arrangement would ultimately result in biased, releasable sliding contact between the belt 125 (FIG. 3) and the printhead region 106 of fluid ejection assembly 102. Movement of the wiping element 122 and printhead region 106 relative to each other results in wiping printheads 112 and face portion 108.

Figure 5:
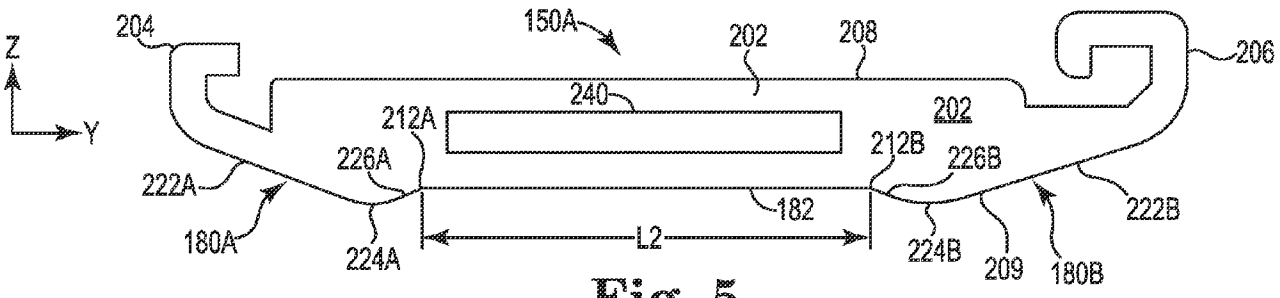
FIG. 5 is a side plan view schematically illustrating a guide element, according to one example of the present disclosure.

FIG. 5 is a diagram including a side plan view schematically illustrating the guide element 150A previously shown in FIGS. 3-4, according to one example of the present disclosure. In one example, guide element 150A includes at some of substantially the same features and attributes of guide portion (G), as previously described and illustrated in association with at least FIG. 2, respectively.

Figure 6:
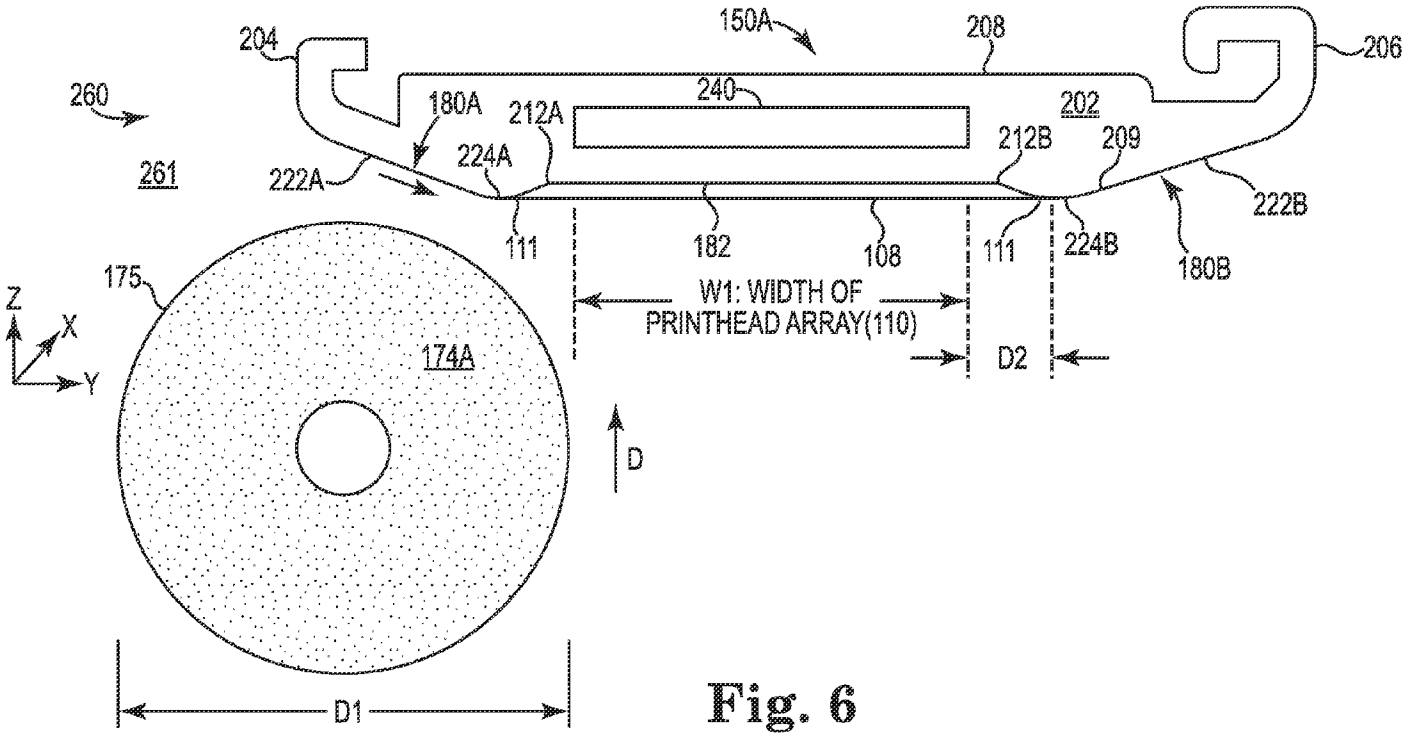
FIG. 6 is a diagram including a side plan view schematically illustrating components of guide system, according to one example of the present disclosure.

As shown in FIG. 5, first guide element 150A includes a generally elongate frame 202 extending between a first end 204 and a second end 206. Frame 202 further defines a top portion 208 and a bottom portion 209 with a mounting slot 240 located generally centrally between the top and bottom portions 208, 209 and between first and second ends 204, 206. In the examples in which the guide elements 150A, 150B are removably attachable relative to the fluid ejection assembly 102, the mounting slot 240 facilitates mounting of guide element 150A relative to housing 104 of fluid ejection assembly 102. In general terms, the bottom portion 209 of frame 202 includes a generally central portion 182 interposed between the opposite, spaced apart receiving portions 180A, 180B, as previously illustrated in FIG. 4. As shown in FIGS. 5-6, the central portion 182 defines a generally planar, flat portion and has a length (L2) at least generally equal to or exceeding a width (W1) of the array 110 of printheads 112 of headland region 106 that extends in the Y orientation (direction of media travel). As further shown in FIG. 6, a distance D2 represents a portion of face portion 108 that extends from a periphery of the array 110 of printheads 112 to the side edge(s) 111 of headland region 106.

In another aspect, with further reference to FIG. 5, each receiving portion 180A, 180B extends generally outward (along length of frame 202) from a respective one of the ends 212A, 212B of central portion 182. Moreover, each receiving portion 180A, 180B of guide element 150A includes a first generally flat, angled portion 222A, 222B, a curved peak portion 224A, 224B, and a second curved, sloped portion 226A, 226B. In general terms, receiving portions 180A, 180B are positioned and shaped to releasably engage guide components associated with wiping assembly 32 (such as wiping element 122) prior to biased engagement of wiping element 122 relative to the headland region 106 of fluid ejection assembly 112. More specific details regarding the role of the portions receiving portions 180A, 180B of guide element 150A are described in association with at least FIGS. 6-12.

FIG. 6 is a diagram 261 including a side plan view of a guide system including one guide element 150A (associated with fluid ejection assembly 102) in relation to one guide component 174A (FIG. 4), according to one example of the present disclosure. In one example, guide element 150A includes at some of the substantially same features and attributes of guide portions (G) and guide elements 150A, 150B, as previously described and illustrated in association with FIGS. 2 and 4-5 respectively. In one example, guide component 174A includes at least some of the substantially same features attributes of guide component 174A, as previously described and illustrated in association with at least FIG. 4.

It will be understood that interaction of guide element 150A and guide component element 174A shown in FIGS. 6-9 represents components present on each opposite end 107 of the headland region (e.g. headland region 106) of a fluid ejection assembly (e.g. fluid ejection assembly 112). As further shown later in FIGS. 10-12, the guide component 174B associated with wiping assembly 32 is present at an opposite end 126B of wiping element 122 for interaction with guide element 150B. The guide component 174B and the guide element 150B have substantially the same features and attributes as guide component 174A and guide element 150A, respectively. Accordingly, interaction of guide component 174A and guide element 150A as depicted in FIGS. 6-9 is representative of a corresponding and simultaneous interaction of the other guide component 174A and other guide element 150B at the other end 126B of wiping element 122 of wiping assembly 32.

Moreover, whereas FIG. 5 illustrates guide element 150A as a standalone element, FIG. 6 represents the guide element 150A in its mounted position relative to a face portion 108 (FIGS. 3-4) of a headland region 106 of fluid ejection assembly 102, as previously illustrated in association with FIGS. 3-4. In one aspect, the portion of face portion 108 visible in FIG. 6 corresponds to an outer portion of the face portion 108 located adjacent one end 107 of headland region 106. In another aspect, as shown in FIG. 6, face portion 108 extends between opposite side edges 111 of headland region 106.

In some examples, while the headland region 106 generally extends in a single plane, it will be understood that the combination of the array 110 of printheads 112 and face portion 108 present some varying topographic surface features such that the headland region 106 does not present an absolutely planar surface.

With further reference to FIG. 6, guide element 174A extends laterally outward from the end 126A of roller 124 (FIG. 4), and therefore roller 124 is not visible in FIG. 6. Moreover, as previously illustrated in association with at least FIG. 4, guide component 174A is aligned to releasably engage guide element 150A to register wiping element 122 in generally a parallel orientation relative to headland region 106 of fluid ejection assembly 102.

In some examples, as shown in FIGS. 5-6, the guide component 174A, 174B has a diameter (D1) that is generally less than a length (L2) of second portion 182 of guide element 150A, 150B.

With this arrangement in mind, a servicing operation is initiated via movement of wiping element 122 (via movement of sled 140) toward an at least temporarily stationary fluid ejection assembly 112 or is initiated via movement of the fluid ejection assembly 112 toward an at least temporarily stationary wiping element 122. In doing so, the guide component 174A is advanced along the Z orientation (as represented by directional arrow D) toward guide element 150A until an outer surface 175 of guide component 174A contacts receiving portion 180A with guide component 174A biased (via biasing mechanism 36 in FIG. 2 and as represented via directional force arrow $F_B$) into slidable contact against flat portion 222A of receiving portion 180A, as further shown in FIG. 7.

Thereafter, relative movement between the wiping element 122 and the fluid ejection assembly 102 results in a sliding movement of the guide component 174A relative to guide element 150A, with surface 175 of guide component 174A sliding along flat angled portion 222A of receiving portion 180A toward central portion 182 of guide element 150A, as represented by directional arrow R. At this point, the wiping element 122 is not yet engaging the headland region 106 of fluid ejection assembly 102. However, because both guide elements 150A, 150B are present at opposite ends 107 of headland region 106, engagement of guide elements 150A, 150B with guide components 174A, 174B (associated with wiping assembly 32) causes and maintains registration of wiping element 122 in a generally parallel relationship to headland region 106.

Figure 7:
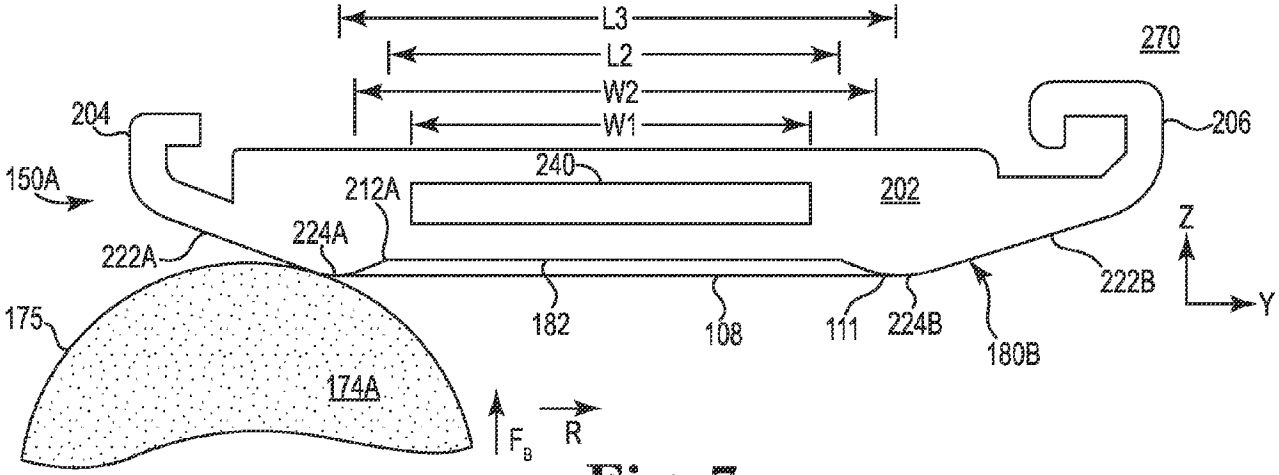
FIG. 7 is a diagram including a side plan view schematically illustrating components of guide system in a first position, according to one example of the present disclosure.

In one aspect, FIG. 7 illustrates a width (W2) of face portion 108 of headland region 106 (between side edges 111) and a distance (L3) between portions 224A, 224B of the respective receiving portions 180A, 180B. As previously noted in association with at least FIG. 5, the length (L2) of second portion 182 of each guide element 150A, 105B is at least equal to or greater than the width (W1) of array 110 of printheads 112. In one aspect, this relationship facilitates the wiping portion (e.g. wiping element 122 in FIG. 3) of wiping assembly 32 (FIG. 2) being in wiping relation to the headland region 106 over substantially the entire surface of at least the printheads 112 of headland region 106.

Figure 10:
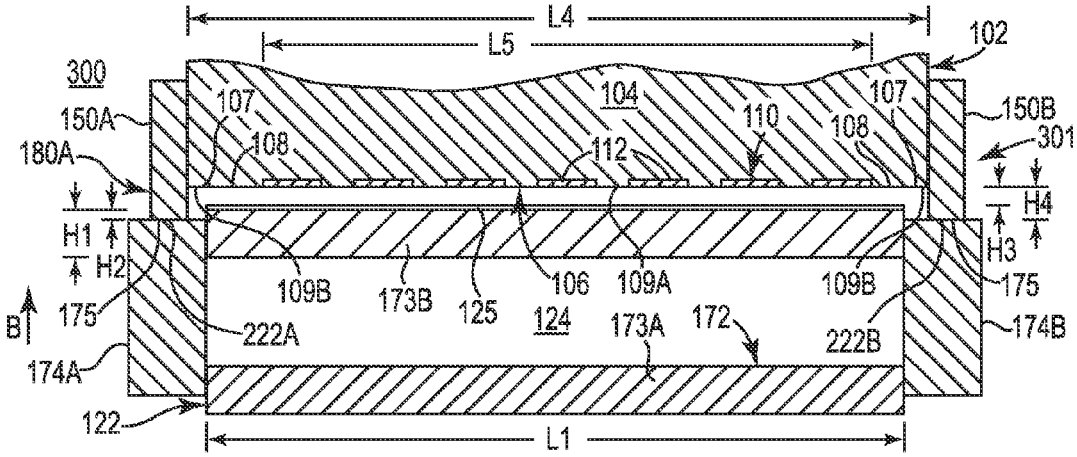
FIG. 10 is a diagram including a sectional front view schematically illustrating components a printing system with components of a guide system in a first position, according to one example of the present disclosure.

FIG. 10 is a diagram 300 including a sectional end view schematically illustrating a printing system, according to one example of the present disclosure. FIG. 10 represents interaction of components of a guide system 301, according to one example of the present disclosure, with the guide system 301 including guide element 150A interacting with guide component 174A and guide element 150B interacting with guide component 174B to cause registration of wiping element 122, in a generally parallel relationship, to headland region 106 of fluid ejection assembly 102.

As shown in FIG. 10, with surface 175 of guide component 174A biased (represented by directional force arrow $F_B$) in slidable contact against portion 222A of receiving portion 180A of guide element 150A, and with surface 175 of guide element 174B biased in slidable contact against portion 222A of receiving portion 180B of guide element 150B, wiping element 122 is in generally parallel registration to headland region 106 and face portion 108 of fluid ejection assembly 112. As further shown in FIG. 10, wiping element 122 includes compressible sleeve 172 concentrically disposed about roller 124, and compressible sleeve 172 in an uncompressed state such that compressible sleeve 172 extends radially outward beyond surface 175 of guide component 174A, 174B by a distance (H2). In one aspect, a thickness of uncompressed sleeve 172 (and belt 125 thereon) is represented by H1 in FIG. 10.

Figure 9:
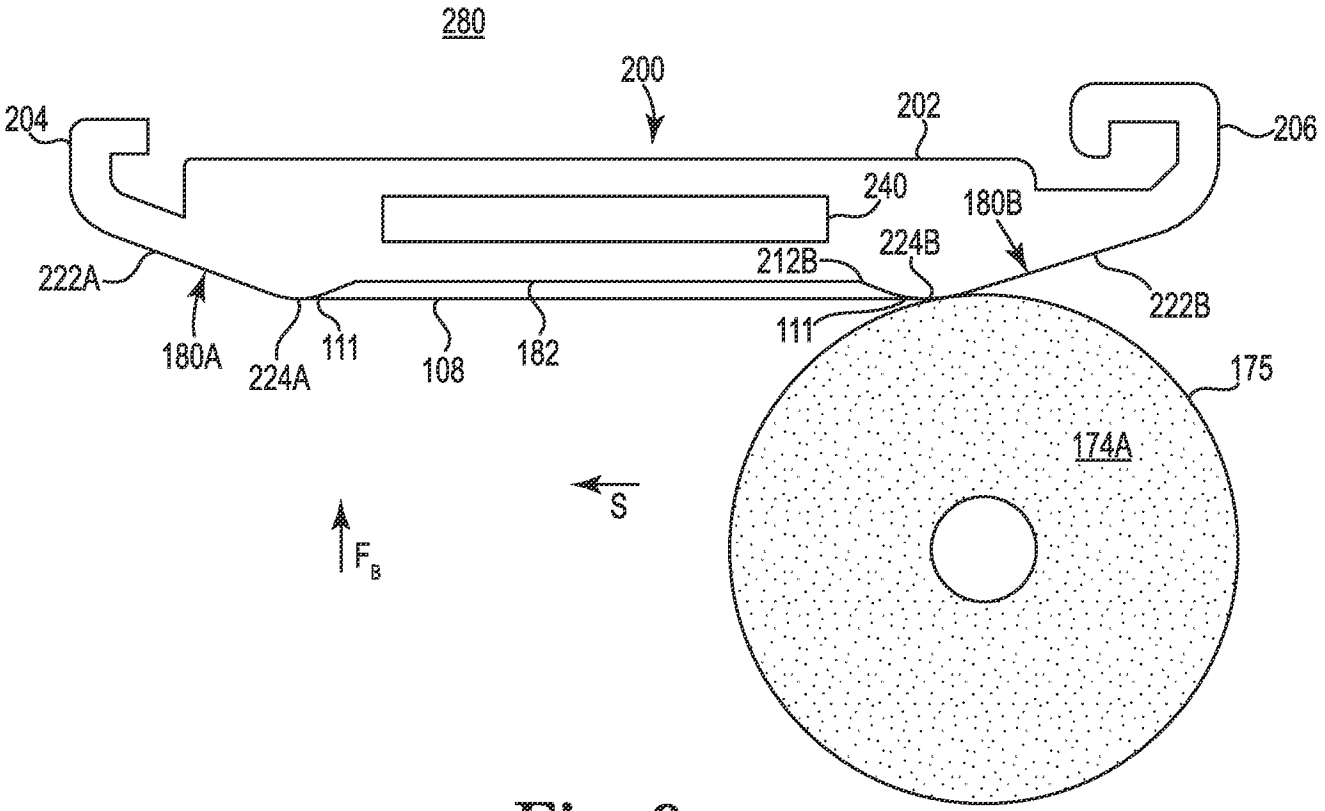
FIG. 9 is a diagram including a side plan view schematically illustrating components of guide system in a third position, according to one example of the present disclosure.

With this arrangement, a gap having a height (H3) exists between headland region 106 and the surface of wiping element 122, such as belt 125 on roller 124. This gap results from the height (H4) of receiving portion 180A, 180B when guide components 174A, 174B are in the position along guide elements 150A, 150B, respectively, as shown in FIG. 9.

In some examples, wiping element 122 has a length (L1 in at least FIGS. 3 and 10) that is slightly less than or equal to a length (L4) of headland region 106, as shown in FIG. 10. However, in some examples, wiping element 122 has a length (L1) greater than the length (L4) of headland region 106. In one aspect, the length (L1) is at least greater than a length (L5) of the array 110 of printheads 112 so that belt 125 of wiping element 122 wipes printheads 112 and a portion of face portion 108 at least partially surrounding the printheads 112, including an outer portion 109B of face portion 108 near opposite ends 107 of headland region 106.

In some examples, as further shown in at least FIG. 10, face portion 108 of headland region 106 includes an inner face portion 109A and a pair of opposite outer face portions 109B with inner portion 109A interposed therebetween. The inner portion 109A at least partially surrounds the individual printheads 112 and extends along the X orientation between the opposite ends of the array 110 of printheads 112. The outer face portions 109B are located externally outward from the opposite ends of the array 110 and therefore, generally devoid of printheads 112.

With the establishment of a generally parallel relation between wiping element 122 and headland region 106 via guide system (guide elements 150A, 150B and guide components 174A, 174B), relative movement of wiping element 122 and headland region 106 can begin to establish a wiping relation between wiping element 122 and headland region 106.

Figure 11:
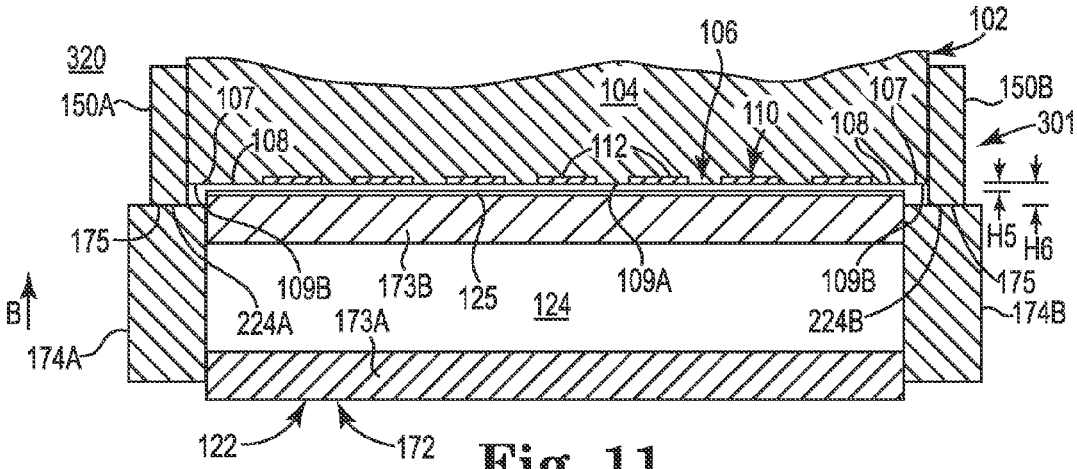
FIG. 11 is a diagram including a sectional front view schematically illustrating a printing system with components of a guide system in an intermediate position, according to one example of the present disclosure.
Figure 12:
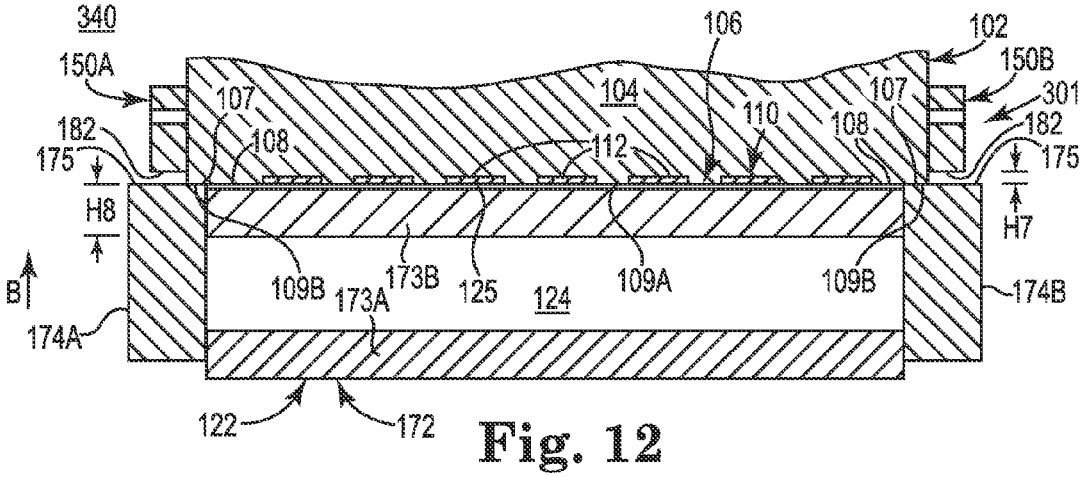
FIG. 12 is a diagram including a sectional front view schematically illustrating a printing system with components of a guide system in a second position, according to one example of the present disclosure.

FIGS. 11-12 represents further snapshots of the interaction of guide element 150A with guide component 174A and guide element 150B with guide component 174B (and resulting interaction of wiping element 122 with headland region 106) and will be later addressed in more detail.

With further reference to FIG. 7, as the relative movement of guide component 174A relative to guide element 150A continues, the surface 175 of guide component 174A slides over peak portion 224A of guide element 150A while maintaining the generally parallel registration of the wiping element 122 and the headland region 106. As this relative movement (between guide component 174A and guide element 150A) continues, guide component 174A begins to slide along downwardly sloping portion 226A of guide element 150A. FIG. 11 illustrates the near contact of belt 125 (outer surface of wiping element 122) with headland region 106 while guide component 174A remains in biased, sliding contact against and moving downward along sloped portion 226A, 226B of guide element 150A. In one aspect, further movement of wiping element 122 toward headland region 106 results in a slight compression of compressible sleeve 172 beneath belt 125.

As further shown in FIG. 11, the distance between the surface of the wiping element 122 (such as belt 125) and headland region 106 has been reduced to a negligible amount (H5) with an effective height of receiving portion 180A resulting in a gap (represented by H6) between face portion 108 and surface 175 of guide components 174A, 174B.

Figure 8:
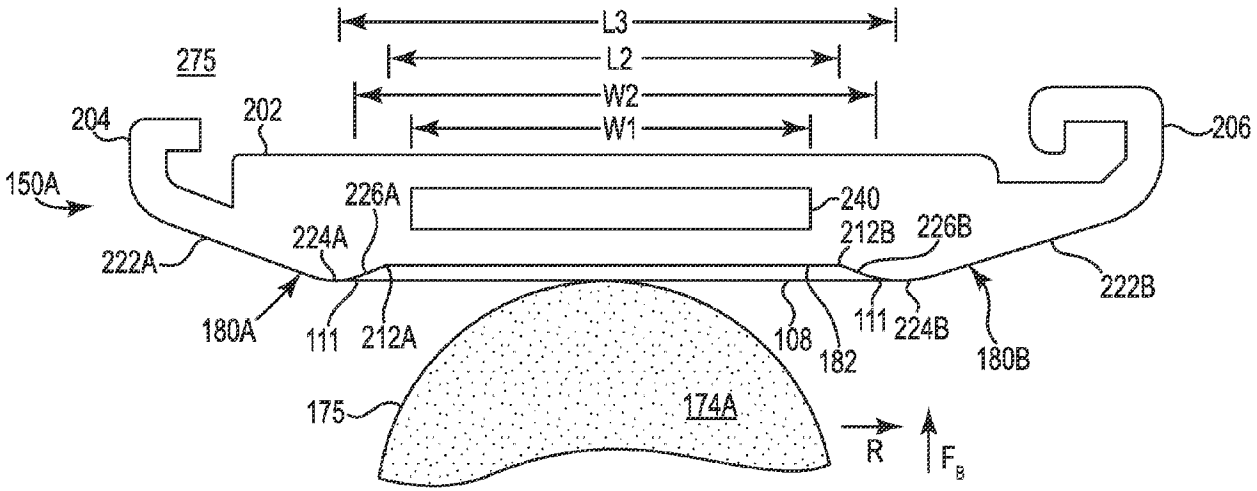
FIG. 8 is a diagram including a side plan view schematically illustrating components of guide system in a second position, according to one example of the present disclosure.

As shown in FIG. 8, upon the guide component 174A having slid away from the downwardly sloped portion 226B, guide component 174A no longer contacts guide element 150A as guide component 174A comes into biased, slidable contact against face portion 108 (262) of headland region 106. In one aspect, this contact against face portion 108 begins at or near a side edge 111 of the headland region 106. In any case, this contact against face portion 108 begins at least before wiping element 122 contacts the printheads 112.

In some examples, this transfer occurs, at least in part, because the face portion 108 has a width (W2 in FIGS. 7-8) that is greater than the length (L2 in FIG. 5) of second portion 182 of guide element 150A, and because the distance (L3) between peak portions 224A, 224B of guide element 150A is greater than the width (W2) of face portion 108. Accordingly, as guide component 174A moves from one of the peak portions 224A, 224B toward second portion 182, the guide component 174A engages face portion 108 before the guide component 174A is able to contact the second portion 182 of guide element 150A. This behavior occurs, at least in part, because the face portion 108 has a width (W2) greater than the length (L2) of second portion 182 and because the second portion 182 is recessed relative to the face portion 108.

In the position shown in FIG. 8, the wiping element 122 (including belt 125) becomes wipingly engaged against printheads 112 (FIG. 2) as shown in FIG. 12 with guide component 174A interacting with face portion 108 to maintain the generally parallel alignment as shown in both FIGS. 8 and 12. With this arrangement, biased sliding contact continues as represented by directional arrow R and directional force arrow $F_B$.

As further shown in FIG. 12, surface 175 of guide components 174A, 175B is no longer in sliding contact against central portion 182 of guide elements 150A, 150B, with the gap between these elements represented by H7. In particular, in this arrangement the biased sliding contact has been transferred to occur between a surface of wiping element 122 (such as belt 125) and printheads 112 of headland region 106, and to occur between surface 175 of guide component 174A, 174B and face portion 108 of headland region 106.

In doing so, further compression of compressible sleeve 172 has taken place as represented by distance H8, which is less than height (H1 in FIG. 10) of uncompressed sleeve 172. In one aspect, the compressible nature of sleeve 172 acts to modulate the varying topology of printheads 112 and face portion 108 in headland region 106 to ensure uniformity in an effective wiping action of belt 125 against headland region 106 during biased sliding contact.

In this arrangement, this biased wiping action occurring under generally parallel conditions provides a close tolerance loop between the surface of wiping element 122 (e.g. belt 125), guide elements 150A associated with wiping element, face portion 108, and printheads 112.

In one aspect, the registration mechanism provided via these examples of the present disclosure avoids the complexity in traditional or existing systems that attempt to achieve a desired wiping relation via each separate assembly (a wiping tool and a fluid ejection device) having its own steering or alignment elements that operate completely independently from each other while still aiming to achieve a desired alignment of those system with each other. Among other deficiencies, these traditional arrangements have large tolerance loops because so many components of each of the separate assembly are involved in attempting to achieve proper alignment of the separate assemblies with each other.

As further shown in FIG. 12, just portion 173B of sleeve 172 that is in contact against headland region 106 is under compression while the portion 173A of sleeve 172 that is not in contact against headland region 106 remains uncompressed.

With the position shown in both FIGS. 8 and 12 being maintained, this wiping action continues until relative movement of guide component 174A and guide element 150A (in the direction R) results in guide component 174A transitioning off of face portion 108 of headland region 106 and back onto sloped portion 226B and peak portion 224B of guide element 150A and peak portion 224B, which in turn results in a surface of wiping element 122 (e.g. belt 125) being no longer in contact against printheads 112 and face portion 108 of headland region 106, as shown in FIGS. 9 and 10.

In some examples, as further shown in FIG. 9, the printing system is operated to move guide component 174A in direction S (opposite direction R, along orientation Y) to cause a second wiping of headland region 106 until guide component 174A reaches the angled portion 220A and wiping element 122 is no longer in contact against headland region 106, as shown in FIG. 7.

In some examples, subsequent iterations of wiping the headland region 106 of fluid ejection assembly 102 are performed using a refreshed or unused portion of belt 125.

Thereafter, a positioner (e.g. positioner 34 in FIG. 2) associated with one of the fluid ejection assembly 102 or the wiping assembly 32 causes these respective assemblies to move away from each other such that guide component 174A of the wiping assembly 32 no longer engages guide element 150A, and wiping element 122 no longer engages headland region 106.

With reference to at least FIGS. 3-4 and 10-12, it will be understood that examples of the present disclosure are not limited solely to the particular arrangement of wiping element 122 including roller 124, sleeve 172, and belt 125. Rather, other structures can serve as a wiping element and be brought into generally parallel registration to, and in wiping relation to, headland region 106 because the interaction of guide components 174A, 174B with guide elements 150A, 105B would remain. Moreover, in some examples, the guide system establishing the generally parallel registration of wiping element 122 relative to headland region 106 is not strictly limited to the particular shape of guide elements 150A, 150B and guide components 174A, 174B shown in FIGS. 3-12. Accordingly, some additional shapes are later described and illustrated in association with FIGS. 13-14.

Figure 13:
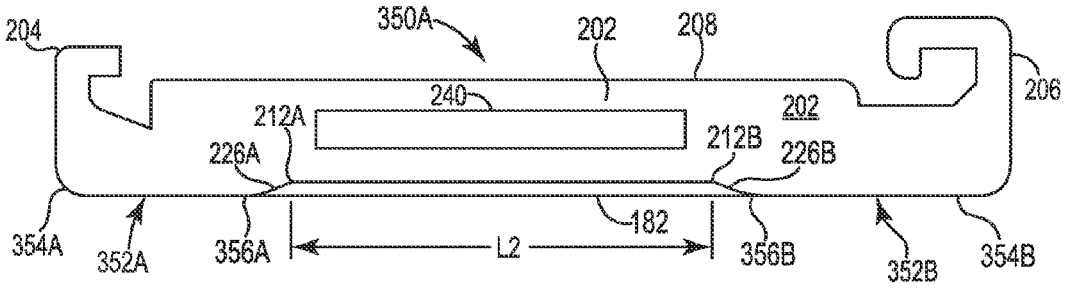
FIG. 13 is a side plan view schematically illustrating a guide element, according to one example of the present disclosure.

FIG. 13 is a diagram including a side plan view schematically illustrating a guide element 350A, according to one example of the present disclosure. In one example, guide element 350A includes at some of substantially the same features and attributes of guide element 150A, as previously described and illustrated in association with at least FIGS. 2-12, with like reference numerals identifying like elements, except with receiving portions 352A, 352B replacing the receiving portions 180A, 180B of guide element 150A, 150B. Similarly, guide element 350A is representative of a guide element 350B in the same way that guide element 150A was representative of guide element 150B.

As shown in FIG. 13, guide element 350A includes a central portion 182 interposed between two spaced apart receiving portions 352A, 352B disposed at opposite ends of the recessed central portion 182. The receiving portions 352A, 352B perform substantially the same function as receiving portions 180A, 180B but have a generally planar portion 354A, 354B instead of the angled portion 222A, 222B present in guide elements 150A, 150B. In this way, the generally planar portions 354A, 354B extend generally parallel to the recessed central portion 182. The receiving portions 352A, 352B each include a generally sloped portion 226A, 22B (as in guide elements 150A, 150B) with a junction 356A, 356B formed between each generally slope portion 226A, 226B and a respective one of the generally planar portions 354A, 354B, respectively.

With this arrangement, a guide component 174A slidably engages the receiving portions 352A, 352B and central portion 182 of guide element 350A, 350B in substantially the same manner as previously described for guide element 150A, 150B in association with FIGS. 2-12.

Figure 14:
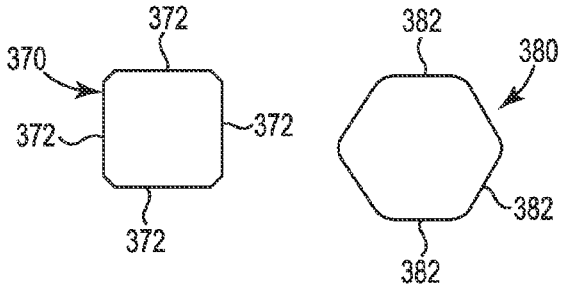
FIG. 14 is a diagram schematically illustrating guide components, according to one example of the present disclosure.

FIG. 14 is a diagram 371 including a side plan view schematically illustrating guide components 370 and 380, according to one example of the present disclosure. In one example, either of the guide components 370, 380 is deployed in substantially the same manner as previously described for guide component 174A (and 174B) in association with FIGS. 2-12, except with the respective guide components 370, 380 having a shape different than the at least partially, generally arcuate shape of guide component 174A. Moreover, because of the guide components 370, 380 are shaped differently than guide component 174A, it will be understood that guide components 370, 380 would slidably engage a guide element, such as guide element 350A that has a correspondingly generally planar-shaped receiving portion 352A, 352B.

In some examples, guide component 370 comprises a generally rectangular shaped member having an array of surface portions 372 for engaging a guide element, such as guide element 350A. In some examples, guide component 380 comprises a generally polygonal shaped member having an array of surface portions 382 for engaging a guide element, such as guide element 350A. The surface portions 372 of guide component 370 and the surface portions 382 of guide component 380 each comprise a generally planar shaped member. Accordingly, unlike the guide component 174A (FIG. 6) that includes an at least partially generally, arcuately-shaped member, each guide component 370, 380 comprises an at least partially generally planar shaped member.

Figure 15:
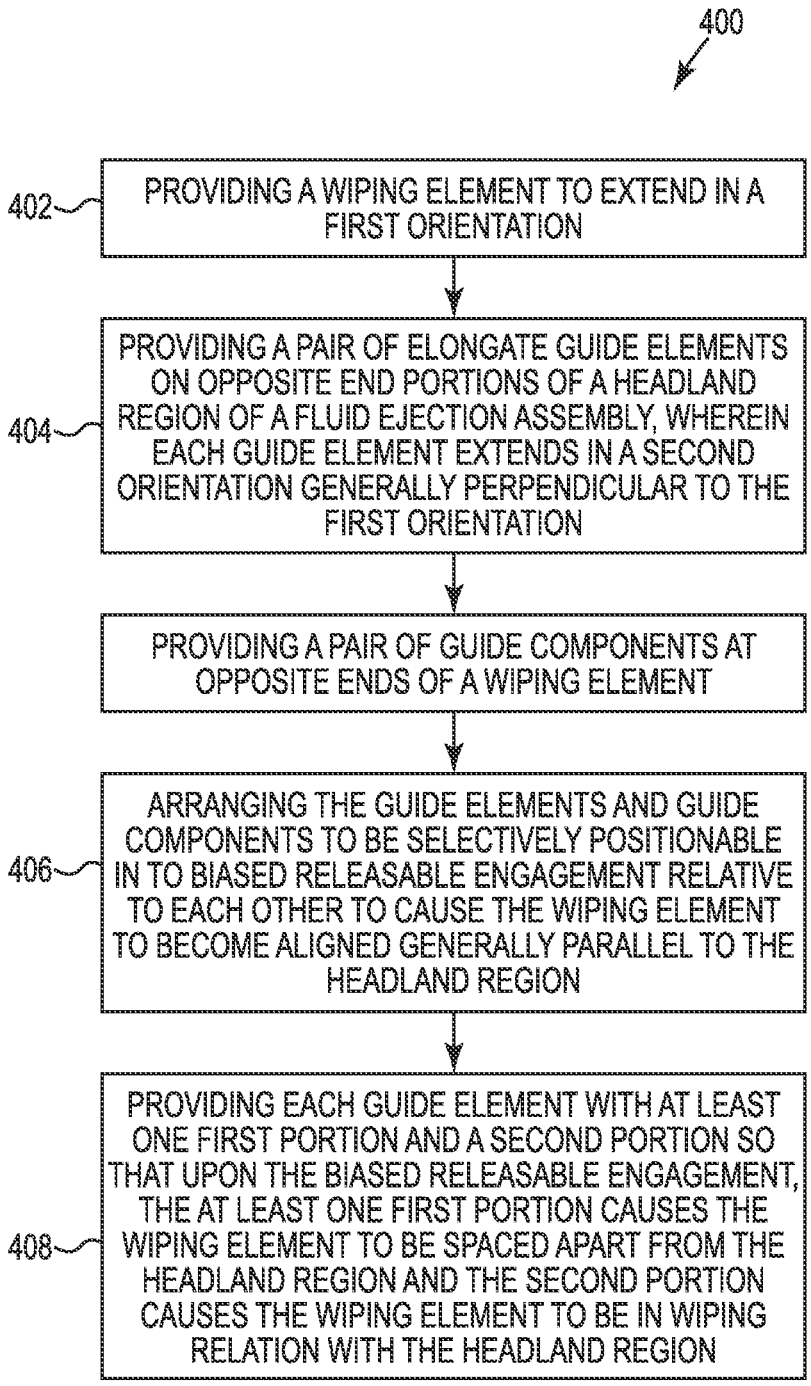
FIG. 15 is a flow diagram of a method of manufacturing a printing system, according to one example of the present disclosure.

FIG. 15 is a flow diagram of a method 400 of manufacturing a printing system, according to one example of the present disclosure. In some examples, method 400 is performed using at least some of the elements, components, modules, and system previously described in association with at least FIGS. 1-14. In some examples, method 400 is performed using at least some elements, components, modules, and system other than those previously described in association with at least FIGS. 1-14.

In one example, as shown at 402 in FIG. 15, method 400 includes providing an elongate wiping element to extend in a first orientation and at 404, coupling a pair of elongate guide elements to opposite ends of a headland region of a fluid ejection assembly, wherein guide element extends in a second orientation generally perpendicular to the first orientation. At 406, method 300 includes, arranging the guide element and a guide component associated with the wiping element to be selectively positionable into biased releasable engagement relative to each other to cause the wiping element to be aligned generally parallel to the headland region. In some examples, the biased releasable engagement includes biased sliding contact. In some examples, the biased releasable engagement includes biased rolling contact.

At 408, method 400 includes providing the guide element with at least one first portion and a second portion so that upon such biased releasable engagement, the at least one first portion causes the wiping element to be spaced apart from the headland region and the second portion cause the wiping element to be in wiping relation to the headland region and with the first guide element no longer contacting the first guide element.

At least some examples of printing systems in the present disclosure are directed to a guide system to guide a wiping element and a headland region of a fluid ejection assembly into a generally parallel wiping relation to each other. At least some examples of the present disclosure operate like a docking arrangement in which one system (e.g. a wiping assembly) and another system (e.g. a fluid ejection assembly) each include a non-wiping component that releasably engage each other to establish proper alignment of the wiping assembly and the fluid ejection assembly in a generally parallel relation to later enable a generally parallel wiping relation. By doing so, a much closer tolerance loop is achieved to ensure precise and accurate alignment of the wiping assembly relative to target surface of the fluid ejection assembly. As noted above, in the one example such docking arrangements are provided via the guide portions of fluid ejection assembly and a non-wiping component of wiping assembly.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this present disclosure be limited only by the claims and the equivalents thereof.

What is claimed is:

1. A wiping assembly comprising:

a pair of guide elements located at opposite ends of a headland region of a fluid ejection assembly to extend in a second orientation generally perpendicular to a first orientation through which the opposite ends extend, wherein each guide element includes:

at least one first portion to receive biased sliding contact from a non-wiping portion of a wiping element to cause a wiping portion of the wiping element, which extends along the first orientation, to be in generally parallel relation to, and spaced apart from, the headland region; and a second portion to cause the non-wiping portion to no longer be in slidable contact against the guide element and the wiping portion to be in biased wiping relation against the headland region.

2. The assembly of claim 1, comprising:

a positioner to position the fluid ejection assembly relative to an at least temporarily stationary position of the wiping element to cause the biased sliding contact between the at least one first portion and the non-wiping portion.

3. The assembly of claim 1, comprising:

a positioner to position the wiping element relative to an at least temporarily stationary position of the fluid ejection assembly to cause the biased sliding contact between the at least one first portion and the non-wiping portion.

4. The assembly of claim 1, wherein the wiping portion of the wiping element is interposed between a pair of the non-wiping portions disposed externally on opposite ends of the wiping portion.

5. The assembly of claim 1, wherein the wiping portion of the wiping element includes a generally elongate cylindrically shaped member and each non-wiping portion comprises a generally disc-shaped member.

6. The assembly of claim 1, wherein each guide element comprises an elongate member with the second portion recessed relative to the at least one first portion and wherein the second portion has a length generally greater than a width of an array of printheads of the headland region, wherein the width extends along the second orientation.

7. The assembly of claim 1, wherein the at least one first portion of each guide element includes two spaced apart first portions with the second portion of the guide element interposed between the two first portions, wherein each first portion defines a receiving portion extending outwardly from the second portion, and wherein each first portion is disposed adjacent opposite side edges of the headland region of the fluid ejection assembly, wherein each side edge of the headland region extends generally parallel to the first orientation.

8. The assembly of claim 7, wherein a distance between the receiving portions is greater than a width of a face portion of the headland region and wherein a length of the headland region is generally parallel to the first orientation.

9. The assembly of claim 1, wherein the second portion of both guide elements extend in substantially the same plane and the at least one first portion of both guide elements extend in substantially the same plane as each other to cause the wiping element to have an orientation that is generally parallel relative to the headland region.

10. The assembly of claim 1, wherein the headland region includes:

a plurality of fluid ejection devices arranged in a page wide array between the opposite ends of the headland region, the array including a first end and an opposite second end; and a face at least partially surrounding the fluid ejection devices and including an inner face portion extending generally along the first orientation between the opposite ends of the array of fluid ejection devices and an outer face portion located externally outward of the opposite ends of the array of fluid ejection devices, wherein the non-wiping portion of the wiping element is in contact against the outer face portion when the wiping portion of the wiping element is in contact against both the array of fluid ejection devices and the inner face portion.

11. The assembly of claim 10, wherein the second portion of the guide elements is recessed relative to the outer face portions such that the non-wiping portion of the wiping element does not contact the second portion of the guide elements when the non-wiping portion of the wiping element is in contact against the outer face portions.

12. A wiping assembly comprising:

an elongate wiping element extending in a first orientation, the wiping element including a wiping portion and a pair of non-wiping portions disposed externally of opposite ends of the wiping portion;

a pair of elongate guide elements located at opposite end portions of a headland region of a fluid ejection assembly to extend in a second orientation generally perpendicular to a first orientation through which the opposite ends extend, wherein each guide element includes a pair of outer receiving portions and an inner portion interposed between, and recessed relative to, the outer receiving portions; and a positioner to cause the wiping element to be in:

a first position in which one of the respective outer receiving portions of the guide element receives biased sliding contact of the non-wiping portion of the wiping element to cause the wiping portion of the wiping element to be in generally parallel relation to, and spaced apart from, the headland region; or a second position in which the non-wiping portion of the wiping element is no longer in slidable contact against the respective outer receiving portion of the guide element and in which the wiping portion of the wiping element is in biased, slidable wiping relation against the headland region.

13. The wiping assembly of claim 12, wherein the headland region includes:

a plurality of inkjet printheads arranged in a page wide array between the opposite end portions of the headland region, the array including a first end and an opposite second end; and a face including an inner face portion extending along the first orientation between the opposite ends of the array of printheads and a pair of outer face portions located externally outward of the opposite ends of the array of printheads, wherein the non-wiping portion of the wiping element is in contact against the outer face portions when the wiping portion of the wiping element is in contact against both the array of printheads and the inner face portion.

14. The wiping assembly of claim 13, wherein the inner portion of the guide elements is recessed relative to the respective outer receiving portions such that the non-wiping portion of the wiping element does not contact the inner portion of the guide elements when the non-wiping portion of the wiping element is in contact against the outer face portion of the headland region.

15. The wiping assembly of claim 12, wherein the non-wiping portions include at least one of an at least partially, generally arcuately shaped member, an at least partially generally rectangular shaped member, or an at least partially generally polygonal shaped member.

16. The wiping assembly of claim 12, wherein the outer receiving portions of the guide element are generally parallel to the recessed inner portion.

17. A method of manufacturing a wiping assembly, comprising:

providing a wiping element to extend in a first orientation;

providing a pair of elongate guide elements on opposite end portions of a headland region of a fluid ejection assembly, wherein each guide element extends in a second orientation generally perpendicular to the first orientation;

providing a pair of guide components at opposite ends of a wiping element;

arranging the guide elements and the guide components to be selectively positionable into biased releasable engagement relative to each other to cause the wiping element to become aligned generally parallel to the headland region; and providing each guide element with at least one first portion and a second portion so that, upon the biased releasable engagement, the at least one portion causes the wiping element to be spaced apart from the headland region and the second portion causes the wiping element to be in wiping relation with the headland region.

18. The method of claim 17, comprises:

providing the headland region to include an array of printheads with the array extending along the first orientation, and interposed between, two outer face portions located laterally external to ends of the array of printheads, wherein providing each guide element with at least one first portion and a second portion comprises:

configuring the second portion of each guide element so that when the wiping element is in wiping relation to the headland region, each guide component engages a respective one of the two outer face portions of the headland region and no longer engages the second portion of the guide element while a wiping portion of the wiping element wipingly engages at least the array of printheads of the headland region.

19. The method of claim 18, wherein the at least one first portion comprises a pair of outer receiving portions with the second portion interposed between, and recessed relative to, the respective outer receiving portions, and wherein the method comprises:

arranging the wiping element and the fluid ejection assembly relative to each other to be positionable to cause the biased releasable engagement initially relative to a respective one of the outer receiving portions before the guide component is positioned along the recessed second portion of the guide element.

20. The method of claim 18, wherein the second portion of each respective guide element has a length greater than a width of the array of printheads, wherein the width of the printheads is generally parallel to the second orientation.

* * * * *